US007354250B2

(12) United States Patent
Sung et al.

(10) Patent No.: US 7,354,250 B2
(45) Date of Patent: Apr. 8, 2008

(54) VARIABLE CAPACITY ROTARY COMPRESSOR

(75) Inventors: Chun Mo Sung, Hwasung-Si (KR); Moon Joo Lee, Suwon-Si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 62 days.

(21) Appl. No.: 11/166,120

(22) Filed: Jun. 27, 2005

(65) Prior Publication Data

US 2006/0093503 A1 May 4, 2006

(30) Foreign Application Priority Data

Oct. 29, 2004 (KR) ..... 10-2004-0087351

(51) Int. Cl.
*F04B 49/00* (2006.01)

(52) U.S. Cl. ..... 417/218; 417/221; 417/223; 417/410.3; 418/29; 418/60; 418/69; 403/355; 403/378; 403/379.3

(58) Field of Classification Search ..... 418/29, 418/60, 63, 69; 417/220, 221, 218, 223; 403/355, 378, 379.3
See application file for complete search history.

(56) References Cited

U.S. PATENT DOCUMENTS

| | | | | |
|---|---|---|---|---|
| 713,301 | A * | 11/1902 | Hagerty | 418/105 |
| 4,452,571 | A | 6/1984 | Koda et al. | |
| 5,802,896 | A * | 9/1998 | Tsai | 70/417 |
| 5,951,261 | A | 9/1999 | Paczuski | |
| 7,104,764 | B2 * | 9/2006 | Lee et al. | 417/218 |
| 2004/0241010 | A1 * | 12/2004 | Cho et al. | 417/410.3 |
| 2005/0002814 | A1 * | 1/2005 | Kim et al. | 418/26 |
| 2005/0079071 | A1 * | 4/2005 | Cho et al. | 417/410.3 |

FOREIGN PATENT DOCUMENTS

| | | | | |
|---|---|---|---|---|
| CN | 1534196 | | 10/2004 | |
| JP | 05180183 | A * | 7/1993 | 418/63 |
| KR | 2002-0044664 | | 6/2002 | |
| KR | 2003-0010844 | | 2/2003 | |
| KR | 20040032358 | A * | 4/2004 | |
| KR | 20050004321 | A * | 1/2005 | |

OTHER PUBLICATIONS

English translation of Chinese Office Action issued with respect to Chinese Application No. 200510082533.X, which corresponds to the above-referenced application.

* cited by examiner

*Primary Examiner*—Theresa Trieu
(74) *Attorney, Agent, or Firm*—Staas & Halsey LLP

(57) ABSTRACT

A variable capacity rotary compressor having a slot defined between eccentric bushes, a latch pin fitted to a rotary shaft so as to be latched to the slot, and a restraint unit for restraining the eccentric bushes upon rotation of the rotary shaft. The restraint unit includes a restraint member mounted in the rotary shaft, a supporting shaft extending from the latch pin to be inserted into the hollow portion of the restraint member, and a return spring interposed between an outer circumference of the supporting shaft and the restraint member to move the restraint member inward toward the center of the rotary shaft when the rotary shaft is not rotated. The restraint unit is easy to manufacture and install and to ensure smooth operation thereof.

4 Claims, 8 Drawing Sheets

VARIABLE CAPACITY ROTARY COMPRESSOR

CROSS-REFERENCE TO RELATED APPLICATIONS

This application claims the benefit of Korean Patent Application No. 2004-87351, filed on Oct. 29, 2004, in the Korean Intellectual Property Office, the disclosure of which is incorporated herein by reference.

BACKGROUND OF THE INVENTION

1. Field of the Invention

The present invention relates to a variable capacity rotary compressor, and more particularly, to a variable capacity rotary compressor capable of preventing collision due to slipping of eccentric bushes.

2. Description of the Related Art

Generally, a variable capacity rotary compressor has an eccentric unit that allows selective eccentric rotation of a roller disposed in a respective one of two compression chambers depending on a rotational direction of a rotary shaft, thereby selectively performing a compression operation. This technology for a variable capacity rotary compressor that is capable of varying refrigerant compression capacity, is disclosed in Korean Patent Application No. 10-2002-0061462 filed by the assignee of the present invention. Such an eccentric unit includes two eccentric cams formed on an outer circumference of the rotary shaft while corresponding to the compression chambers, respectively, two eccentric bushes rotatably coupled around the two eccentric cams to bear rollers against their outer circumferences, respectively, and a latch pin for latching one of the two eccentric bushes (also referred to as bushings) to its eccentric position and the other one to its non-eccentric position upon rotation of the rotary shaft. The eccentric unit operates to allow the compression operation to be carried out in only one of the two compression chambers with different capacities, thereby realizing variable capacity operation through simple change of the rotational direction of the rotary shaft.

Another kind of a variable capacity rotary compressor that is capable of preventing slip of the eccentric bushes during the compression operation as stated above is disclosed in Korean Patent Application No. 10-2003-0044459, filed by the assignee of the present invention. The disclosed compressor has a restraint unit for restraining the eccentric bushes upon rotation of the rotary shaft. Such a restraint unit includes a restraint member adapted to protrude outward from the rotary shaft upon receiving a centrifugal force caused by rotation of the rotary shaft for restraining the eccentric bushes, an inner supporting pin mounted in the rotary shaft to limit a forward/backward movement range of the restraint member, and a return spring fitted on the outer circumference of the inner supporting pin and adapted to return the restraint member inward toward the center of the rotary shaft when the rotary shaft is not rotated so as to remove restriction of the eccentric bushes.

The compressor as stated above restrains the eccentric bushes as the restraint member protrudes outward from the rotary shaft upon receiving the centrifugal force caused by rotation of the rotary shaft, thereby preventing slip of the eccentric bushes and hence preventing generation of noise due to collision between the eccentric bushes and the latch pin.

SUMMARY OF THE INVENTION

Accordingly, it is an aspect of the present invention to provide a variable capacity rotary compressor having an improved restraint unit for restraining eccentric bushes that is easy to manufacture and install and ensures more smooth operation thereof.

Additional aspects and/or advantages of the invention will be set forth in part in the description which follows and, in part, will be obvious from the description, or may be learned by practice of the invention.

The foregoing and/or other aspects of the present invention are achieved by a variable capacity rotary compressor including a slot defined between eccentric bushes, a latch pin fitted to a rotary shaft so as to be latched to the slot, and a restraint unit for restraining the eccentric bushes upon rotation of the rotary shaft. The restraint unit includes a restraint member mounted in the rotary shaft to move forward or rearward in a radial direction of the rotary shaft, a hollow portion, a supporting shaft extending from the latch pin to be inserted into the hollow portion of the restraint member, and a return spring interposed between an outer circumference of the supporting shaft and the restraint member to move the restraint member inward toward the center of the rotary shaft when the rotary shaft is not rotated.

The restraint unit may further include an inwardly protruding portion formed in the restraint member to support one end of the return spring, and a nut to be fastened on a distal thread portion of the supporting shaft extending in the restraint member to support the other end of the return spring.

The restraint member may be mounted in the rotary shaft opposite to the latch pin to be latched to an end of the slot located at the opposite side of the latch pin.

The restraint member may have a large-diameter portion fitted in a fitting hole formed in the radial direction of the rotary shaft to move forward or backward, and a small-diameter portion having an outer diameter smaller than that of the large-diameter portion to be inserted into and latched to the slot.

The latch pin may have a head portion protruding outward from an outer circumference of the rotary shaft to be inserted into and latched to the slot, and a screw portion having an outer diameter smaller than that of the head portion and larger than that of the supporting shaft, the screw portion being fastened into the rotary shaft.

BRIEF DESCRIPTION OF THE DRAWINGS

These and/or other aspects and advantages of the invention will become apparent and more readily appreciated from the following description of the embodiments, taken in conjunction with the accompanying drawings, of which.

DETAILED DESCRIPTION OF THE PREFERRED EMBODIMENTS

Figure 1:
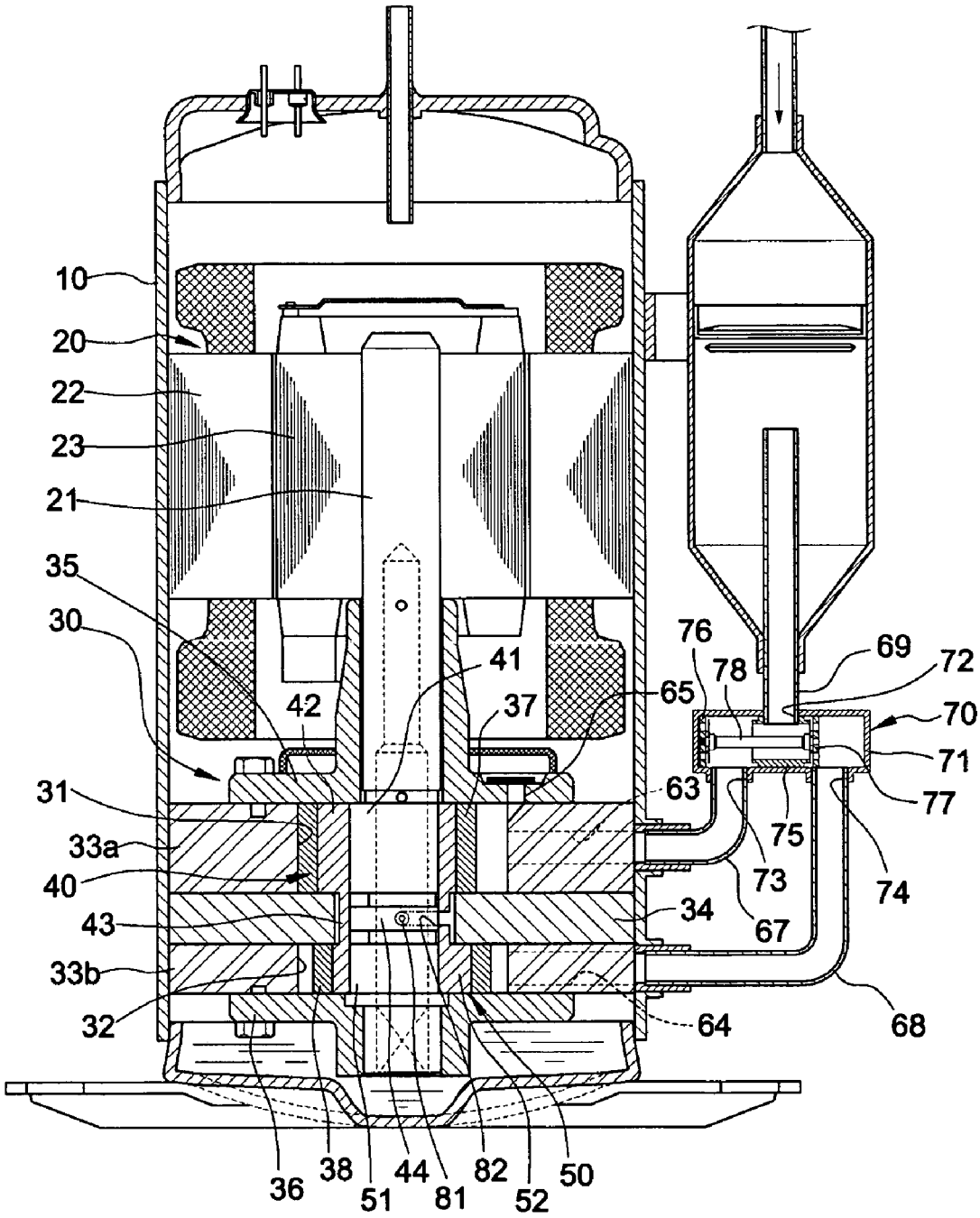
FIG. 1 is a longitudinal sectional view showing the interior structure of a variable capacity rotary compressor according to the present invention.

Reference will now be made in detail to the embodiments of the present invention, examples of which are illustrated in the accompanying drawings, wherein like reference numerals refer to like elements throughout. The embodiments are described below to explain the present invention by referring to the figures.

In FIG. 1, the variable capacity rotary compressor includes a driving unit 20 disposed in a hermetically sealed container 10 for generating a rotary force, and a compressing unit 30 connected to the driving unit 20 via a rotary shaft 21.

The driving unit 20 includes a cylindrical stator 22 fixed on an inner circumference of the hermetically sealed container 10, and a rotor 23 rotatably disposed in the stator 22 to be centrally fitted on the rotary shaft 21. The driving unit 20 rotates the rotary shaft 21 in a forward or reverse direction.

The compressing unit 30 includes upper and lower housings 33*a* and 33*b*, respectively, defining first and second compression chambers 31 and 32 each shaped to form a cylinder with different capacities. The compressing unit 30 further includes upper and lower flanges 35 and 36 disposed, respectively, at an upper surface of the upper housing 33*a* and a lower surface of the lower housing 33*b* for closing the top of the first compression chamber 31 and the bottom of the second compression chamber 32 and rotatably supporting the rotary shaft 21, and an intermediate plate 34 interposed between the upper and lower housings 33*a* and 33*b* for partitioning the first and second compression chambers 31 and 32.

Figure 2:
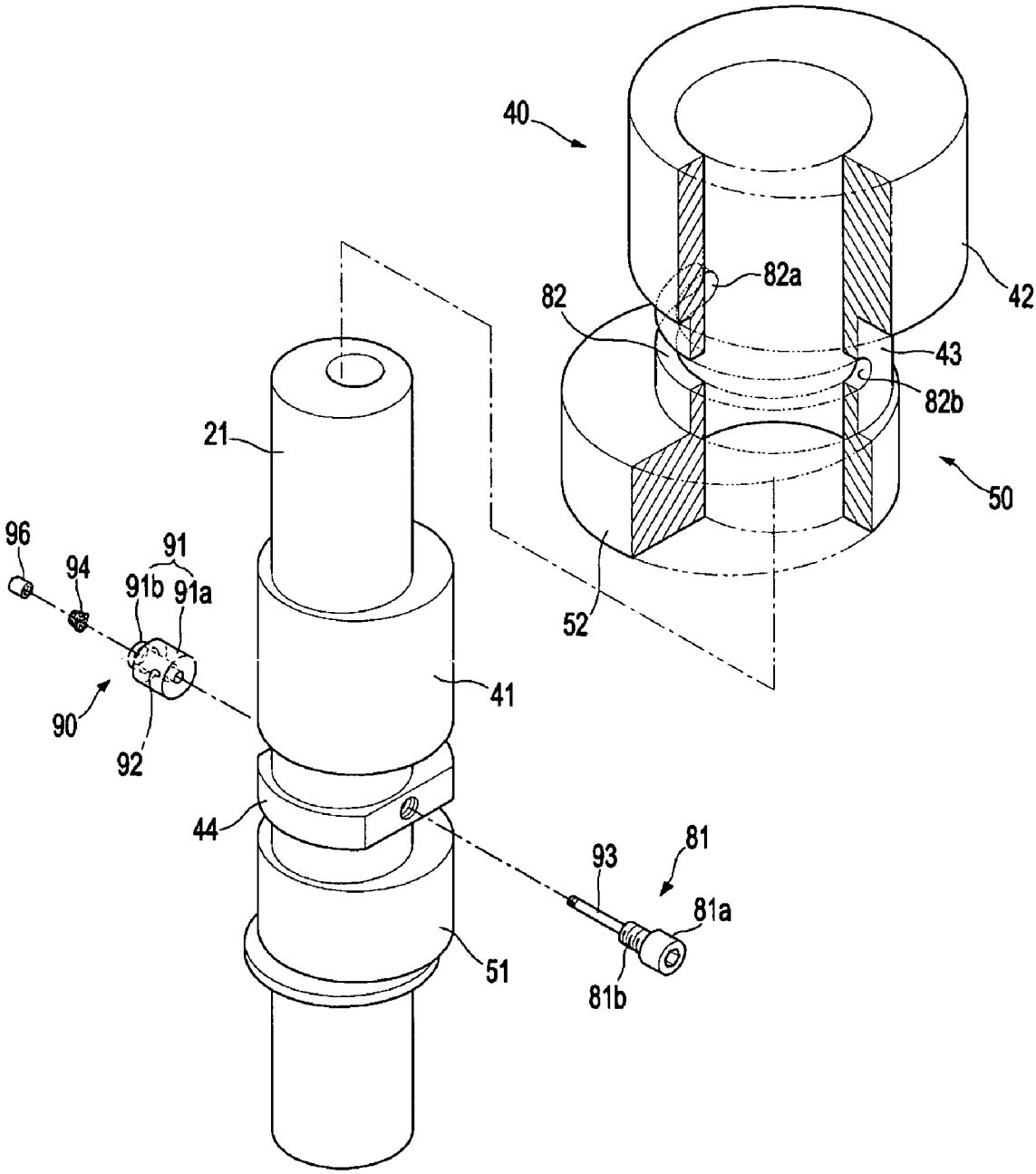
FIG. 2 is an exploded perspective view showing eccentric units provided in the variable capacity rotary compressor of FIG. 1.
Figure 3:
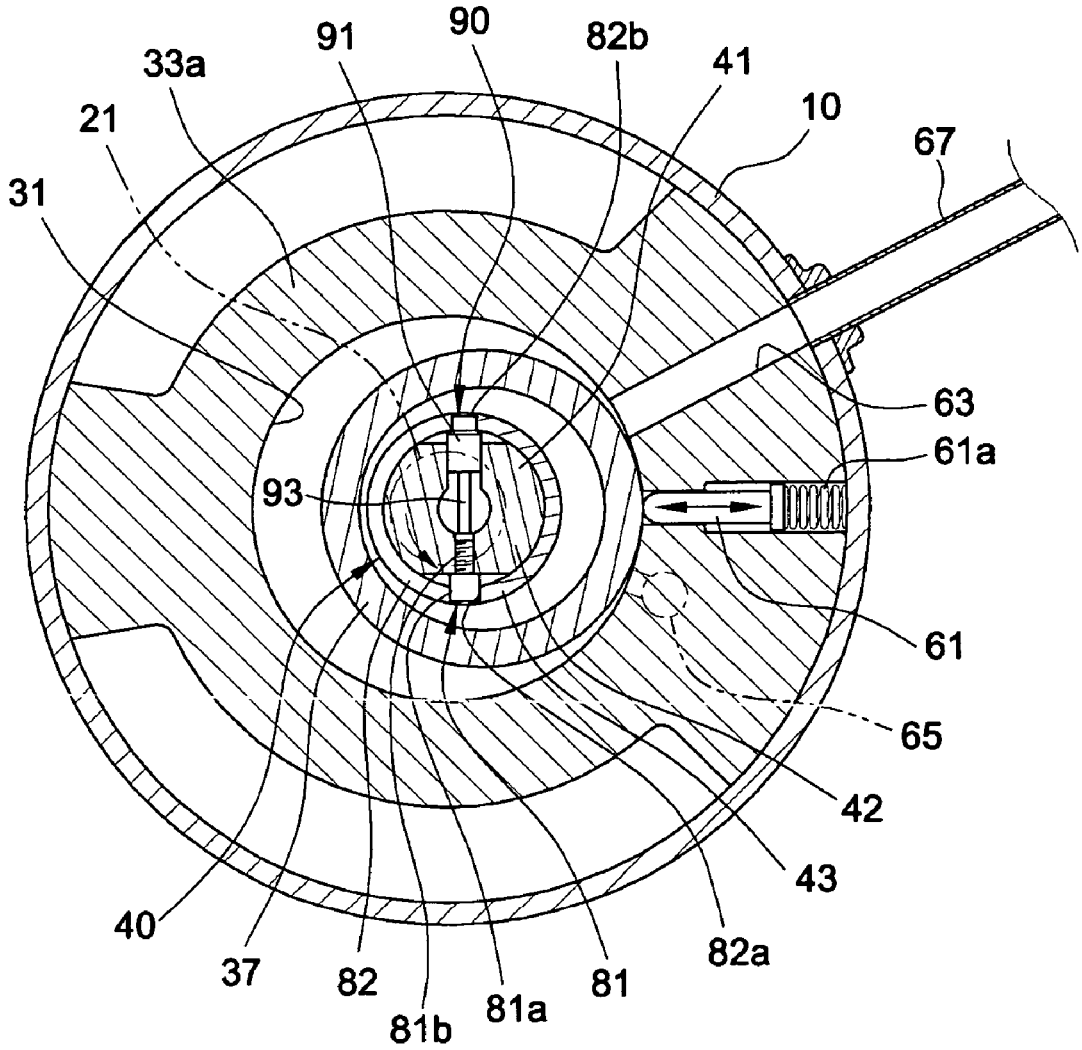
FIG. 3 is a cross-sectional view showing a compression operation in a first compression chamber when a rotary shaft of the variable capacity rotary compressor is rotated in a first rotational direction.
Figure 4:
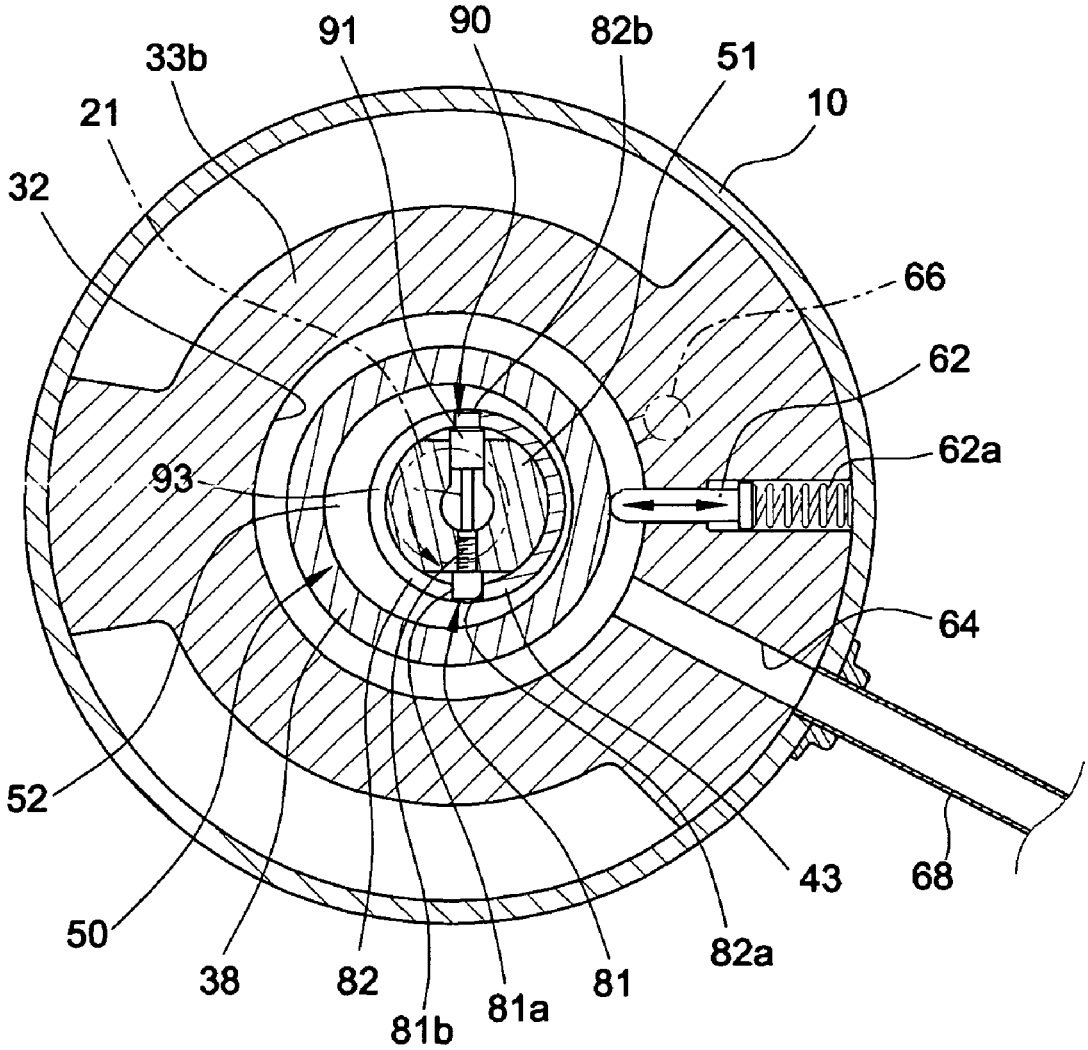
FIG. 4 is a cross-sectional view showing an idling operation in a second compression chamber when the rotary shaft is rotated in the first rotational direction.

In the first and second compression chambers 31 and 32 are disposed, respectively, a first eccentric unit 40 and a second eccentric unit 50 around the rotary shaft 21, as shown in FIGS. 1 to 4. The first and second eccentric units 40 and 50 bear against first and second rollers 37 and 38 rotatably coupled at their outer circumferences, respectively. Between an inlet 63 and an outlet 65 of the first compression chamber 31 is disposed a first vane 61 (not shown in FIG. 1; see FIG. 3), and between an inlet 64 and an outlet 66 (not shown in FIG. 1; see FIG. 4) of the second compression chamber 32 is disposed a second vane 62 (not shown in FIG. 1; see FIG. 4). The first and second vanes 61 and 62 are pressed against the first and second rollers 37 and 38 as they radially move forward and backward in contact with outer circumferences of the rollers 37 and 38. The first and second vanes 61 and 62 are supported by first and second vane springs 61*a* and 62*a*, respectively, as shown in FIGS. 3 and 4.

The inlet 63 and the outlet 65 of the first compression chamber 31 and the inlet 64 and the outlet 66 (not shown in FIG. 1; see FIG. 4) of the second compression chamber 32 are positioned at opposite sides of the respective vanes 61 (not shown in FIG. 1; see FIG. 3) and 62 (not shown in FIG. 1; see FIG. 4). The eccentric units 40 and 50, disposed in the compression chambers 31 and 32, operate to allow the compression operation to be carried out in only one of the two compression chambers 31 and 32 as the rotational direction of the rotary shaft 21 changes, thereby realizing a variable capacity compression operation. The detailed construction of the eccentric units 40 and 50 will be described below.

As shown in FIG. 1, the variable capacity rotary compressor according to the present invention includes a channel switching unit 70 for selectively opening/closing and introducing channels such that a refrigerant in a suction channel 69 is introduced into only one of the inlet 63 of the first compression chamber 31 and the inlet 64 of the second compression chamber 32, where a compression operation is carried out.

The channel switching unit 70 includes a cylindrical body 71, and a valve unit mounted in the body 71. An entrance 72 is centrally formed at an upper surface of the cylindrical body 71. The suction channel 69 is connected to the entrance 72. The first and second exits 73 and 74, formed at a lower surface of the cylindrical body 71, are connected to introducing channels 67 and 68. The introducing channels 67 and 68 are connected to the inlets 63 and 64 of the first and second compression chambers 31 and 32, respectively.

The valve unit, mounted in the body 71 includes a cylindrical valve seat 75 mounted in the center of the body 71, first and second opening/closing members 76 and 77 movably disposed at opposite sides of the valve seat 75 in the body 71 so as to open or close opposite ends of the valve seat 75, and a connecting member 78 connecting the first and second opening/closing members 76 and 77 to enable simultaneous movement of the opening/closing members 76 and 77. In such a channel switching unit 70, on the basis of the pressure difference between the exit 73 and the exit 74 caused when the compression operation is carried out in only one of the first and second compression chambers 31 and 32, the first and second opening/closing members 76 and 77 disposed in the body 71 move toward a low pressure region, achieving automatic switching of the introducing channels 67 and 68.

Referring to FIGS. 1 to 4, the first and second eccentric units 40 and 50, disposed in the first and second compression chambers 31 and 32 include first and second eccentric cams 41 and 51 formed on the outer circumference of the rotary shaft 21 disposed in the respective compression chambers 31 and 32 to be eccentrically rotated in the same direction as each other, and first and second eccentric bushes 42 and 52 (also referred to as first and second eccentric bushings 42 and 52) rotatably coupled around outer circumferences of the eccentric cams 41 and 51, respectively. As can be seen from FIG. 2, the upper first eccentric bush 42 and the lower second eccentric bush 52 are integrally connected to each other via a cylindrical connection portion 43 to be eccentrically rotated in directions opposite to each other (see also FIG. 1). The first and second rollers 37 and 38 are rotatably coupled to the outer circumferences of the first and second eccentric bushes 42 and 52.

On the outer circumference of the rotary shaft 21 between the first and second eccentric cams 41 and 51 is formed an eccentric portion 44 as shown in FIG. 2. The eccentric portion 44 is designed to be eccentrically rotated in the same manner as the eccentric cams 41 and 51. To the eccentric portion 44 is mounted a latch unit, and a restraint unit 90 (see FIG. 2). The latch unit allows selective eccentric rotation of the eccentric bushes 42 and 52 depending upon the rotational direction of the rotary shaft 21. The restraint unit 90 is adapted to restrain the eccentric bushes 42 and 52 as it protrudes outward in the radial direction of the rotary shaft 21 upon receiving a centrifugal force caused by rotation of the rotary shaft 21.

The configuration and operation of the latch unit will now be described with reference to FIGS. 1 to 8. The latch unit includes a latch pin 81 screwed into a flat portion defined on part of an outer circumference of the eccentric portion 44 to protrude outward, and a slot 82 formed along the circumference of the connection portion 43 connecting the first and second eccentric bushes 42 and 52. The slot 82, being relatively long in length, allows the latch pin 81 to be latched thereto at eccentric and non-eccentric positions of the eccentric bushes 42 and 52 as the rotary shaft 21 is rotated in a forward or reverse direction.

The latch pin 81 has a head portion 81*a* protruding outward from the outer circumference of the rotary shaft 21 to be inserted into and latched to the slot 82, and a screw portion 81*b* having an outer diameter smaller than that of the head portion 81*a* and adapted to be fastened into the rotary shaft 21. When the latch pin 81 is screwed into the eccentric portion 44 of the rotary shaft 21 and is inserted into the slot 82 of the connection portion 43, the latch pin 81 is rotated over a predetermined angle upon rotation of the rotary shaft 21, so that it is latched to either a first end 82*a* or a second end 82*b* of the slot 82, causing the eccentric bushes 42 and 52 to rotate along with the rotary shaft 21.

When the latch pin 81 is latched to either the first end 82*a* or the second end 82*b* of the slot 82, one of the two eccentric bushes 42 or 52 is in an eccentric state, whereas the other one of the eccentric bushes 52 or 42 is in a non-eccentric state, allowing one of the compression chambers 31 or 32 to perform the compression operation and the other one of the compression chambers 32 or 31 to perform the idling operation. Such a selective eccentric operation of the eccentric bushes 42 and 52 depends on the rotational direction of the rotary shaft 21.

With reference to FIGS. 2 to 8, the configuration and operation of the restraint unit 90 will now be described in detail. The restraint unit 90, mounted on the rotary shaft 21 opposite to the latch pin 81, includes a cylindrical restraint member 91, a supporting shaft 93, and a return spring 94. The cylindrical restraint member 91, having a hollow portion 92, is mounted in the rotary shaft 21 in a radially movable manner to protrude outward from the eccentric portion 44 upon receiving the centrifugal force caused by rotation of the rotary shaft 21. The supporting shaft 93 extends from the screw portion 81*b* of the latch pin 81 into the hollow portion 92 of the restraint member 91 and is adapted to guide forward or backward movement of the restraint member 91 while supporting the restraint member 91.

The return spring 94 is interposed between an outer circumference of the supporting shaft 93 and an inner circumference of the restraint member 91 defining the hollow portion 92, and is adapted to push the restraint member 91 inward toward the center of the rotary shaft 21 when the rotary shaft 21 is not rotated. In this case, the supporting shaft 93 is integrally formed with the latch pin 81, and preferably has an outer diameter that is smaller than an outer diameter of the screw portion 81*b* of the latch pin 81 for facilitating its installation.

Figure 8:
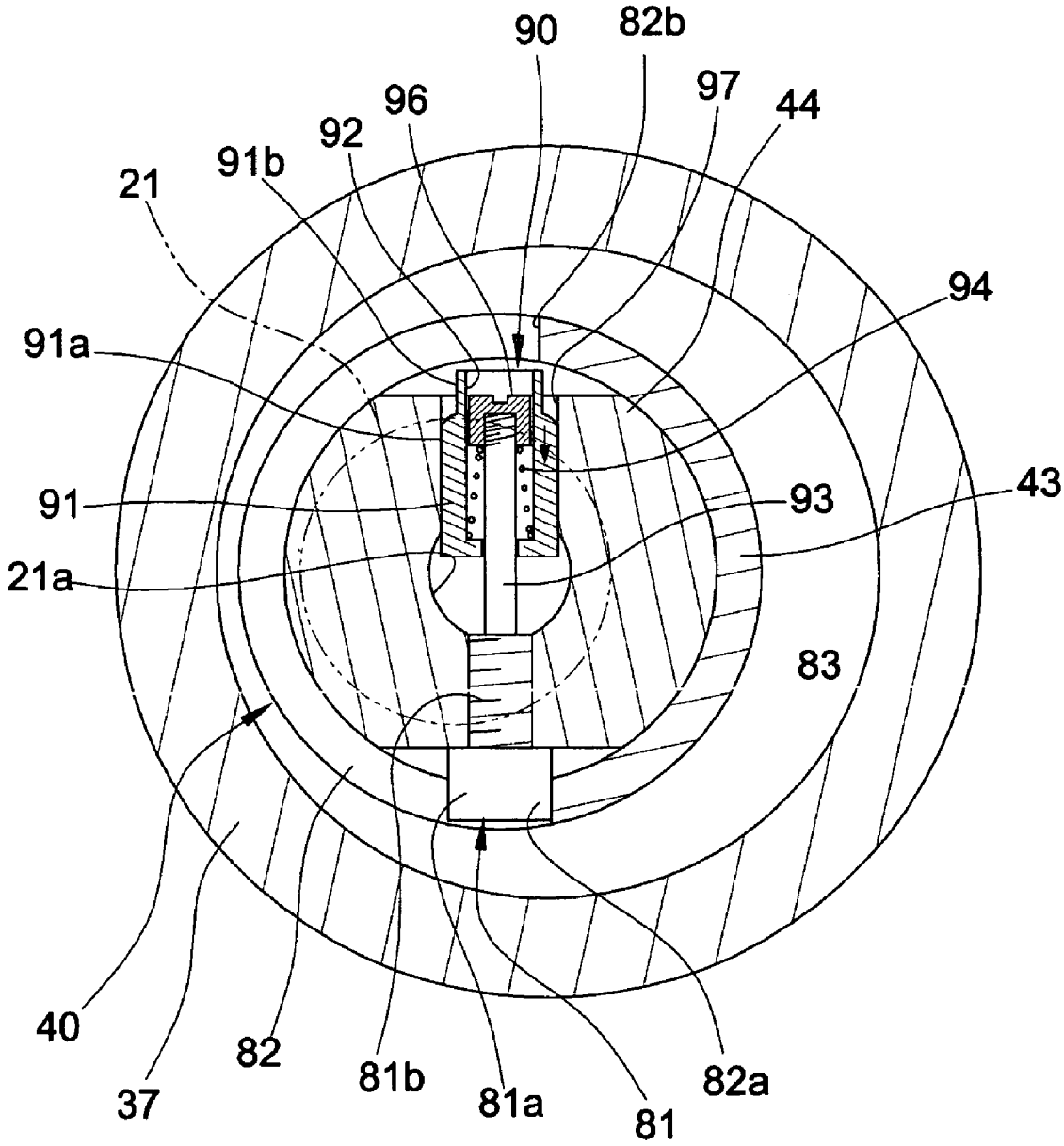
FIG. 8 is a sectional view showing a restriction removal operation of the restraint unit of FIG. 7.

The restraint unit 90 further includes an inwardly protruding portion 95 formed as an inner diameter reduced portion at one end of the hollow portion 92 of the restraint member 91 to support one end of the return spring 94, and a nut 96 to be fastened on a distal thread portion of the supporting shaft 93 extending in the restraint member 91 to support the other end of the return spring 94. Preferably, the return spring 94 is shaped to form a cone to be easily supported at both ends by the inwardly protruding portion 95 and the nut 96. As shown in FIG. 8, with such a configuration, the restraint member 91 is moved inward toward the center of the rotary shaft 21 due to the elasticity of the return spring 94 when the rotary shaft 21 is not rotated, so as not to restrict the eccentric bushes.

The restraint member 91 is divided into a large-diameter portion 91*a* having a relatively large outer diameter wherein the restraint member is movably fitted in a fitting hole 97 formed in the radial direction of the rotary shaft 21, and a small-diameter portion 91*b* having an outer diameter smaller than that of the large-diameter portion 91*a* suitable to be inserted into and latched to the slot 82. As can be seen from FIG. 7, with such a configuration, when the restraint member 91 protrudes outward in the radial direction of the rotary shaft 21 due to the centrifugal force caused by rotation of the rotary shaft 21, only the small-diameter portion 91*b* of the restraint member 91 is inserted into the slot 82 and latched to the second end 82*b* of the slot 82. In this case, the large-diameter portion 91*a* of the restraint member 91 is not allowed to be inserted into the slot 82 as it is intercepted by the second end 82*b* of the slot 82. This limits the outward protrusion of the restraint member 91. The large-diameter portion 91*a* also serves to increase the weight of the restraint member 91, ensuring smooth and stable outward protrusion of the restraint member 91 from the rotary shaft 21 during rotation of the rotary shaft 21.

The installation of the restraint unit 90 and the latch pin 81 to the rotary shaft 21 includes inserting the restraint member 91 completely into the fitting hole 97 of the rotary shaft 21, and fitting the eccentric bushes 42 and 52, which were previously connected to each other via the connection portion 43, on the outer circumference of the rotary shaft 21. Then, the latch pin 81 is fastened opposite to the restraint member 91. In such a fastened state of the latch pin 81, the supporting shaft 93 extending from the latch pin 81 is inserted into the hollow portion 92 of the restraint member 91. In succession, the rotary shaft 21 is rotated until the head portion 81*a* of the latch pin 81 is latched to the first end 82*a* of the slot 82, so that the hollow portion 92 of the restraint member 91 is exposed to the outside via an opposite portion of the slot 82. The return spring 94 is inserted into the hollow portion 92 of the restraint member 91, and the nut 96 is fastened in the restraint member 91. In this case, it is easy to fasten the return spring 94 and the nut 96 to the restraint member 91 since the supporting shaft 93, extending from the latch pin 81, is positioned and fixedly maintained in the center of the restraint member 91.

Now, the operation of the variable capacity rotary compressor described above will be explained.

When the rotary shaft 21 is rotated in a first direction as shown in FIG. 3, the outer circumference of the first eccentric bush 42, disposed in the first compression chamber 31, is eccentric relative to the rotary shaft 21 and the latch pin 81 is latched to the first end 82*a* of the slot 82. Thereby, the first roller 37 is rotated in contact with an inner circumference of the first compression chamber 31, causing a compression operation in the first compression chamber 31.

In the case of the second compression chamber 32, as shown in FIG. 4, the outer circumference of the second eccentric bush 52, which is eccentrically rotatable in the direction opposite to that of the first eccentric bush 42, is concentric about the rotary shaft 21. Therefore, the second roller 38 is spaced apart from an inner circumference of the second compression chamber 32. When the compression operation is carried out in the first compression chamber 31, the refrigerant is introduced into the inlet 63 of the first compression chamber 31 as the channel switching unit 70 selects an introducing channel for introducing the refrigerant into only the first compression chamber 31.

The operation described above is possible under the assumption that the first and second eccentric cams 41 and 51 are eccentrically rotated in the same direction as each other, whereas the first and second eccentric bushes 42 and 52 are eccentrically rotated in directions opposite to each other. That is, if the maximum eccentric part of the first eccentric cam 41 and the maximum eccentric part of the first eccentric bush 42 have the same eccentric direction as each other, the maximum eccentric part of the second eccentric cam 51 and the maximum eccentric part of the second eccentric bush 52 have eccentric directions opposite to each other.

When the compression operation described above is carried out, as shown in FIG. 7, the restraint member 91 protrudes outward from the rotary shaft 21 due to the centrifugal force caused by rotation of the rotary shaft 21 and is latched to the second end 82*b* of the slot 82 located at the opposite side of the latch pin 81, thereby serving to restrain the eccentric bushes 42 and 52. Such an operation of the restraint member 91 prevents slip of the eccentric bushes 42 and 52 caused when the eccentric bushes 42 and 52 are rotated faster than the eccentric cams 41 and 51, thereby preventing the latch pin 81 from colliding with the first or second end 82*a* or 82*b* of the slot 82. In this way, the restraint member 91 restrains the eccentric bushes 42 and 52 to prevent slip of the eccentric bushes and the collision of the latch pin, resulting in reduced operational noise and improved durability and reliability of the compressor.

When the compressor is stopped, as shown in FIG. 8, the restraint unit 90 removes the restriction of the eccentric bushes 42 and 52 as the restraint member 91 is pulled inward toward the center of the rotary shaft 21 due to the elasticity of the return spring 94. In such an inwardly pulled state of the restraint member 91, if the rotary shaft 21 is rotated in a second direction opposite to the first direction, the restraint member 91 is rotated without interference of the connection portion 43 as the latch pin 81 is moved away from the first end 82*a* of the slot 82. As a result, the positions of the latch pin 81 and the restraint member 91 are reversed as compared to the compression operation described above. During such rotation of the restraint member 91, the eccentric bushes 42 and 52 are not rotated and only the rotary shaft 21 is rotated over a predetermined angle.

Figure 5:
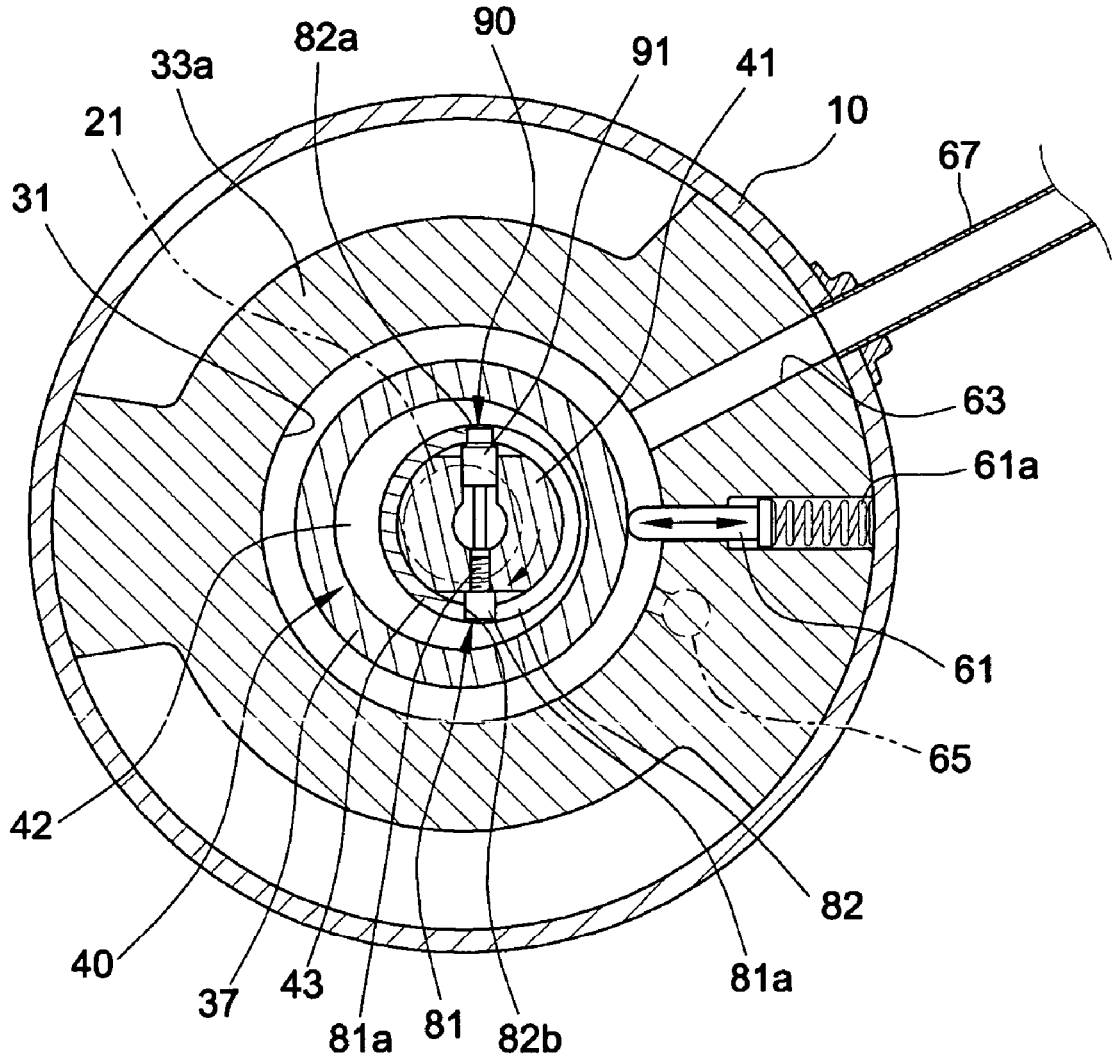
FIG. 5 is a cross-sectional view showing an idling operation in the first compression chamber when the rotary shaft is rotated in a second rotational direction.
Figure 6:
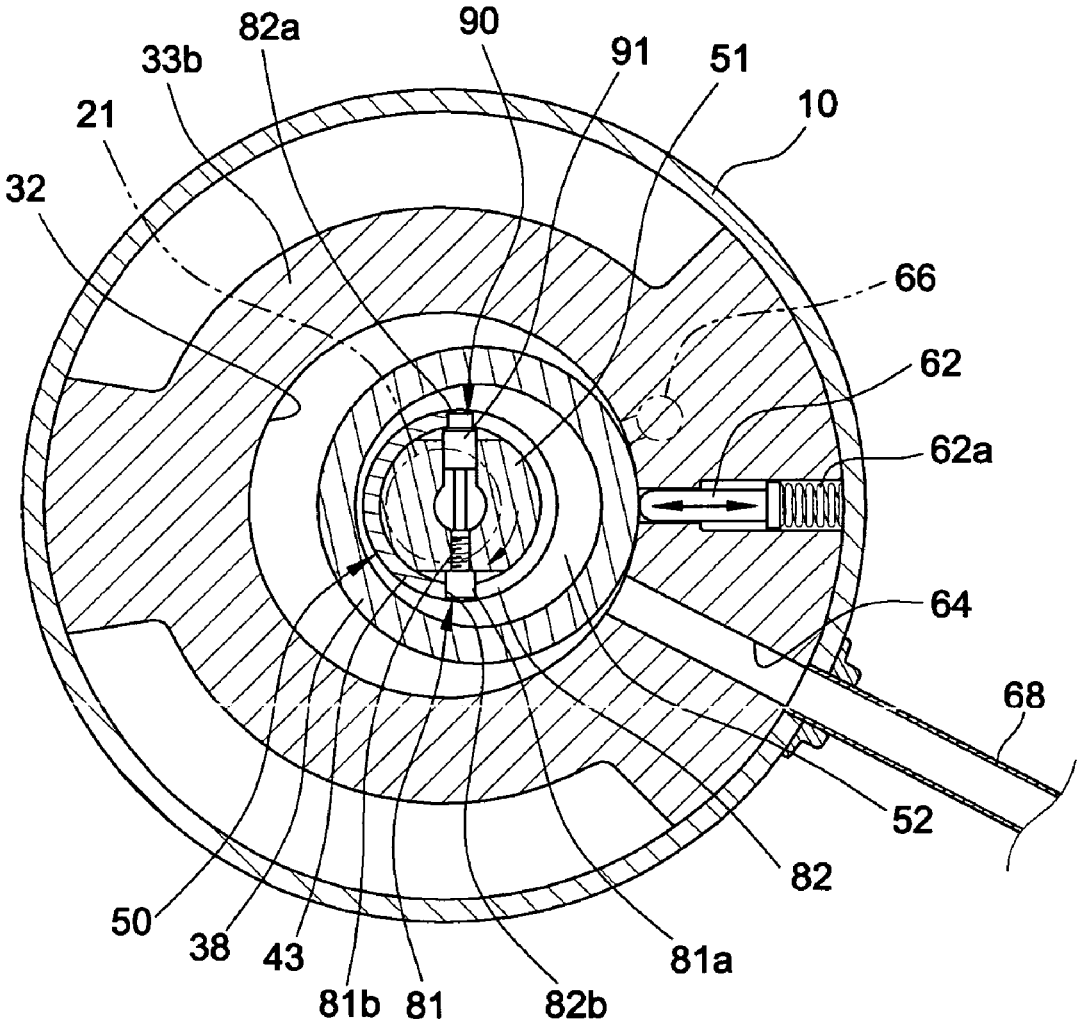
FIG. 6 is a cross-sectional view showing a compression operation in the second compression chamber when the rotary shaft is rotated in the second rotational direction.
Figure 7:
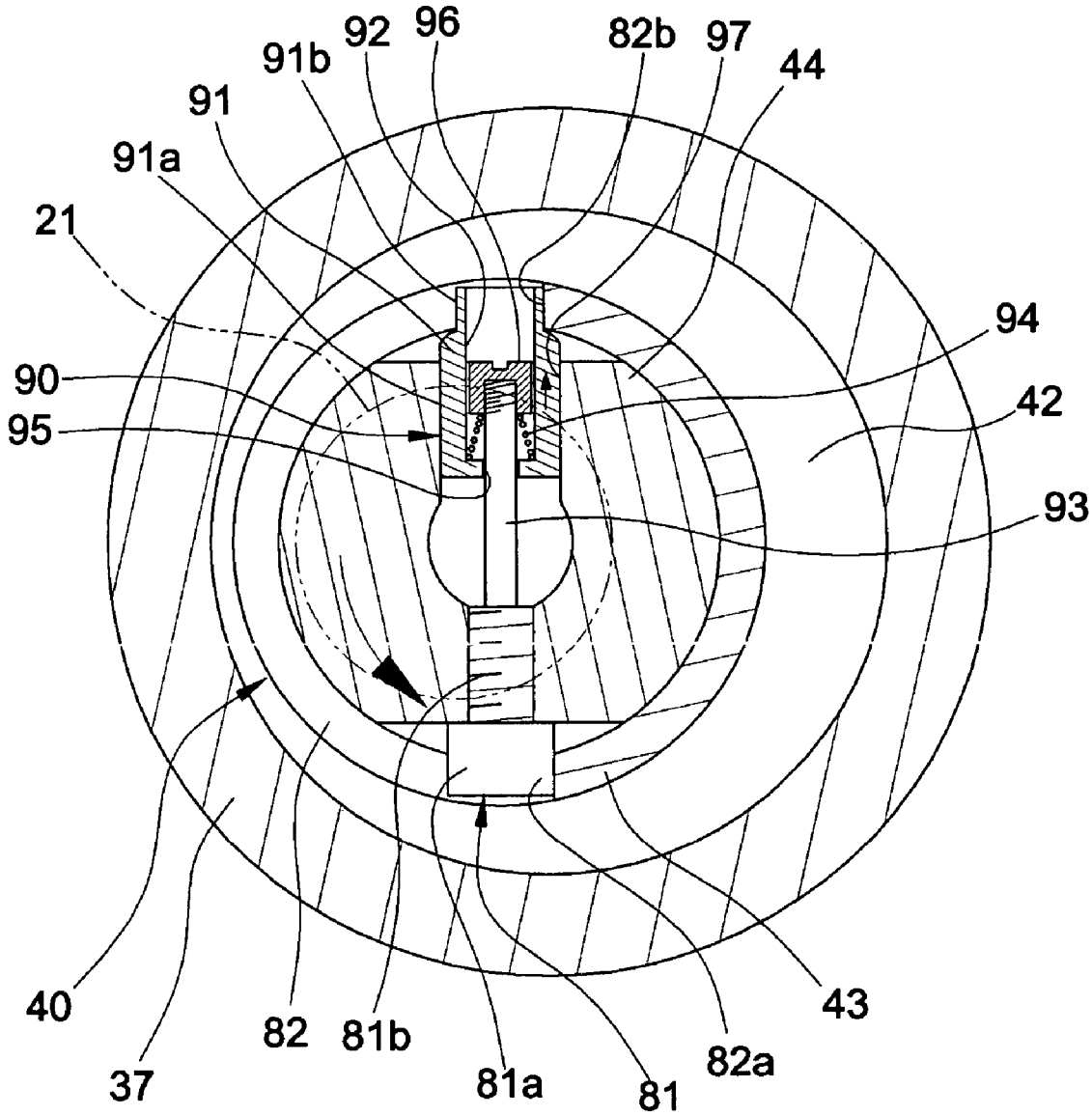
FIG. 7 is a cross-sectional view showing a restriction operation of a restraint unit provided in the variable capacity rotary compressor of FIG. 1.

When the rotary shaft 21 is rotated in the second direction opposite to the first direction, as shown in FIG. 5, the outer circumference of the first eccentric bush 42, disposed in the first compression chamber 31, is non-eccentric relative to the rotary shaft 21 and the latch pin 81 is latched to the second end 82*b* of the slot 82. Thereby, the first roller 37 is rotated while being spaced apart from the inner circumference of the first compression chamber 31, causing an idling operation in the first compression chamber 31. In the case of the second compression chamber 32, as shown in FIG. 6, the outer circumference of the second eccentric bush 52 is eccentrically rotated relative to the rotary shaft 21, and thus the second roller 38 is rotated in contact with the inner circumference of the second compression chamber 32, resulting in a compression operation in the second compression chamber 32.

When the compression operation is carried out in the second compression chamber 32, the refrigerant is introduced into the inlet 64 of the second compression chamber 32 as the channel switching unit 70 selects an introducing channel for introducing the refrigerant into only the second compression chamber 32. Further, the restraint member 91 protrudes outward from the rotary shaft 21 due to the centrifugal force caused by rotation of the rotary shaft 21 and is latched to the first end 82*a* of the slot 82 located at the opposite side of the latch pin 81, thereby serving to restrain the eccentric bushes 42 and 52.

As is apparent from the above description, an aspect of the present invention provides a variable capacity rotary compressor having a restraint unit that is capable of selectively restraining rotation of eccentric bushes. Further, the restraint unit is configured in such a fashion that a restraint member thereof is supported by a supporting shaft extending from a latch pin, a return spring is interposed between an inner circumference of the restraint member defining a hollow portion and an outer circumference of the supporting shaft extending in the restraint member, and a nut is fastened to a distal thread portion of the supporting shaft to support the return spring. Such a restraint unit s easy to manufacture and install, and to ensure smooth operation thereof.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. An apparatus comprising:

a slot defined between eccentric bushes;

a latch pin fitted to a rotary shaft such that it is latched to the slot; and a restraint unit to restrain the eccentric bushes when the rotary shaft is rotated, the restraint unit comprising:

a restraint member mounted in the rotary shaft to move forward or rearward in a radial direction of the rotary shaft, the restraint member having a hollow portion;

a supporting shaft extending from the latch pin to be inserted into the hollow portion of the restraint member;

a return spring interposed between an outer circumference of the supporting shaft and the restraint member to move the restraint member inward toward the center of the rotary shaft when the rotary shaft is not rotated;

an inwardly protruding portion formed in the restraint member to support one end of the return spring; and a nut being fastened on a distal thread portion of the supporting shaft extending in the restraint member to support the other end of the return spring.

2. The apparatus according to claim 1, wherein the restraint member is mounted in the rotary shaft such that the restraint member is opposite to the latch pin to be latched to an end of the slot located at the opposite side of the latch pin.

3. The apparatus according to claim 2, wherein the restraint member comprises:

a large-diameter portion fitted in a fitting hole formed in a radial direction of the rotary shaft to move forward or backward; and a small-diameter portion having an outer diameter smaller than that of the large-diameter portion to be inserted into and latched to the slot.

4. The apparatus according to claim 1, wherein the latch pin comprises:

a head portion protruding outward from an outer circumference of the rotary shaft to be inserted into and latched to the slot; and a screw portion having an outer diameter smaller than that of the head portion and larger than that of the supporting shaft, the screw portion being fastened into the rotary shaft.

* * * * *